United States Patent [19]

Nagahara et al.

[11] 3,941,472

[45] Mar. 2, 1976

[54] PHOTOSENSITIVE DRUM FOR ELECTROPHOTOGRAPHIC COPYING MACHINES

[75] Inventors: Yasumori Nagahara, Yokosuka; Kohji Suzuki, Yokohama, both of Japan

[73] Assignee: Ricoh Co., Ltd., Tokyo, Japan

[22] Filed: Aug. 17, 1973

[21] Appl. No.: 389,226

[30] Foreign Application Priority Data

Aug. 21, 1972 Japan ..... 47-83531

[52] U.S. Cl. ..... 355/16; 96/1.5; 317/2 H; 355/3 R; 355/3 DD; 355/15

[51] Int. Cl.[2] ..... G03G 15/22

[58] Field of Search.... 355/16, 17, 15, 3 DD, 3 CH, 355/3 R, 3 DR; 96/1.5, 1 R; 178/6.6 DD, 6.7 R, 7.4; 242/55; 310/7; 15/1.5; 427/21; 317/2 H

[56] References Cited

UNITED STATES PATENTS

| | | | |
|---|---|---|---|
| 2,277,013 | 3/1942 | Carlson | 355/3 R X |
| 2,829,025 | 4/1958 | Clemens et al. | 96/1.5 UX |
| 3,480,361 | 11/1969 | Tatsumi Doi et al. | 355/16 |
| 3,588,242 | 6/1971 | Berlier et al. | 355/16 |
| 3,610,749 | 10/1971 | Madrid | 355/17 |
| 3,611,028 | 10/1971 | Whitmore | 317/2 H |
| 3,728,016 | 4/1973 | Harbour et al. | 355/15 |
| 3,867,026 | 2/1975 | Ogawa | 355/16 X |

*Primary Examiner*—L. T. Hix
*Assistant Examiner*—Kenneth C. Hutchison
*Attorney, Agent, or Firm*—Cooper, Dunham, Clark, Griffin & Moran

[57] ABSTRACT

An electrically insulated minor portion is provided on the periphery of a photosensitive drum comprising a cylindrical supporter, a photoconductive strip wound in roll form on a supply reel disposed in the interior of the cylindrical supporter and paid out thereof to apply a portion thereof to a major portion of the outer periphery of the cylindrical supporter so that the portion may serve as a photoreceptor on which an electrostatic latent image of an original to be copied is formed. The strip portion on the outer periphery is withdrawn and wound on a take-up reel that is also disposed in the interior of the cylindrical supporter. The minor portion of the outer periphery of the cylindrical supporter has on its surface an electrically insulating layer with electrical resistance in the range of 1 to $5 \times 10^9 \Omega$cm, the layer consisting of a material which is not charged by frictional contact with either the magnetic developing brush or the cleaning brush.

7 Claims, 5 Drawing Figures

PHOTOSENSITIVE DRUM FOR ELECTROPHOTOGRAPHIC COPYING MACHINES

BACKGROUND OF THE INVENTION

The invention relates to photosensitive drums for electrophotographic copying machines, and is concerned with a photosensitive drum of the type which has a photosensitive strip stored as a supply roll in the interior of the drum and paid out therefrom such that a portion of the strip is around a major portion of the outer periphery of the drum to serve as a photoreceptor on which an electrostatic latent image of an original to be copied is formed.

In the transfer-printing electrophotographic duplication process, an electrostatic latent image of an original is formed on a photoconductive material layer which is an electrophotographic photoreceptor, and this latent image is developed into a visible image with a developing agent including electrostatically attracted minuscule particles referred to as toner. Then, successive copy sheets are brought into contact with the developed toner image to form on each copy sheet an image of the original by transfer printing. The photoreceptor on which the electrostatic latent image is formed in this type of electrophotography is preferably a portion of a pliable photoconductive strip which is wound on a supply reel in a cylindrical supporter. It is paid out therefrom to be applied to a major portion of the outer periphery of the cylindrical supporter, and is taken up by a take-up reel, which is also inside the cylindrical supporter.

After producing about 5,000 copies by transfer printing, the photoreceptor deteriorates. If it is of the type formed by vapor deposition in vacuum of a photoconductive material on the outer periphery of the drum, the drum itself must be replaced by a new one. When a photoconductivee strip wound on a supply reel in the interior of the drum is used and one portion after another thereof is successively used as a photoreceptor by paying out the same and applying it on the outer periphery of the drum, one has only to replace the strip by a new one when all the portions of the strip have been used. Thus, the cost involved is very low when a photoconductive strip is used by winding on a drum to provide a photosensitive drum.

A photoconductive strip 1 of this type is shown in FIG. 1, and comprises a polyester film base 1*a*, an electrically conductive material layer 1*b* formed on the base 1*a* by vapor deposition in vacuum of aluminum, and a photosensitive material layer 1*c* formed on the photoconductive material layer 1*b* by applying a mixture of an organic semiconductor, such as polyvinyl carbazole, with a binder and sensitizer. The photoconductive strip 1 has a thickness of about 0.1 millimeter, and its electrically conductive material layer 1*b* is suitably grounded. When the photoconductive strip 1 is exposed to an optical image of an original, an electrostatic latent image is formed on the photosensitive material layer 1*c*.

As seen in FIGS. 2 and 3, a photosensitive drum 2 has a portion of a photoconductive strip 1 wound on a major portion (about three quarters) of the outer periphery of a cylindrical supporter 4 made of aluminum or other conductive material and is rotatably supported by a shaft 3. More specifically, the photoconductive strip 1 is secured at one end to a supply reel 5 disposed within and parallel to the cylindrical supporter 4 for rotation and is wound thereon in roll form. The other end of the photoconductive strip 1 is pulled out through a slit 4*a* formed in the outer periphery of the cylindrical supporter 4 and disposed axially thereof, and is inserted through another slit 4*b* into the interior of the supporter 4 to be wound on a take-up reel 6 disposed in a position diametrically opposite to the position in which the supply reel 5 is disposed, after a portion of the strip 1 is applied to about three quarters, or a major portion of the outer periphery of the cylindrical supporter 4. The portion of the strip 1 which is disposed on the outer periphery of the supporter 4 serves as a photoreceptor which makes up a photosensitive drum 2 together with the cylindrical supporter 4.

The supply reel 5 and take-up reel 6 are supported by shafts 5*a* and 6*a* respectively which are supported for rotation by two end walls of the cylindrical supporter 4.

When it is desired to replace the used photoreceptor portion on the outer periphery of the cylindrical supporter 4 by a new one, the take-up reel 6 is rotated in the direction of an arrow *a* shown in FIG. 4 and the photoconductive strip 1 is advanced so that the portion of the photoconductive strip 1 disposed on the outer periphery of the cylindrical supporter is withdrawn and wound on the take-up reel 6. At the same time, the supply reel 5 is rotated in the direction of an arrow *b* and the photoconductive strip 1 wound in roll form thereon is paid out, so that the next following portion of the photoconductive strip 1 is pulled out through slit 4*a* and applied to the outer periphery of the cylindrical supporter 4 to serve as a new photoreceptor.

The electrically conductive material layer 1*b* (see FIG. 1) of the portion of the photoconductive strip 1 or the photoreceptor on the outer periphery of the cylindrical supportor 4 should normally be grounded. The cylindrical supporter 4 as well as the supply reel 5 and take-up reel 6 disposed in the interior of the supporter 4 are each made of an electrically conductive material; they are in electrical contact with each other and can be suitably grounded. However, the photoconductive strip has a base 1*a* which is made of an insulating material and it is the only part of the strip 1 that comes into contact with the supply reel 5 and the take-up reel 6, so that the electrically conductive material layer 1*b* of the strip is insulated.

For the purpose of electrically grounding the strip 1, as seen in FIG. 5, a tongue-shaped portion 1*d*, at the leading end of the strip 1, is adapted to be inserted in a slit 5*a* formed in the supply reel 5. This portion 1*d* has its electrically conductive material layer 1*b* exposed to make electrical contact with the supply reel 5 when the tongue-shaped portion 1*d* is inserted in the slit 5*a*. Since the supply reel 5 is electrically connected to the cylindrical supporter 4 supported by shaft 3, which is grounded, the electrically conductive material layer 1*b* of the photoconductive strip 1 can thus be grounded.

A prior art photosensitive drum 2 constructed as aforementioned can be used as follows. Referring to FIG. 4, the photosensitive drum 2 rotates in the direction of an arrow *c* and produces a sequence of copies of an original by an electrophotographic duplicating process relying on transfer printing. The photosensitive drum 2 is rotated as its support shaft 3 is rotated at a constant rate by a synchronous motor (not shown). A cleaning brush 7 contacts the photoreceptor and cleans its surface so that the photoreceptor may be uniformly charged.

A charging station is disposed adjacent to the cleaning station. Disposed in the charging station is a charging device 10 including an array of a corona discharge electrode (or electrodes) 9 disposed across the surface of the outer periphery of the drum 2 and enclosed by a shield member 8. Being connected to a high voltage power source, the charging device 10 is effective to cause the photoconductive material layer to carry a uniform static charge thereon.

An exposure station is disposed adjacent the charging station. As is well known, an optical system 11 is disposed in this station to expose the surface of the photoconductive strip 1 to an optical image of an original to be duplicated. The portions of the surface of the photoconductive strip 1 which are exposed to the optical image have their charge removed so as to form thereon an electrostatic latent image of the original.

A developing station is disposed adjacent the exposure station and includes a developing device 12 for providing a developing agent carrying an electric charge opposite to that of the electrostatic image. The developing device 12 comprises a developing agent tank 14 containing therein a developing agent 13 and a magnetic brush 15 rotatably mounted in the tank 14. The developing agent 13 adhering to an outer peripheral surface of the magnetic brush 15 rotating in the direction of an arrow *d* is supplied to the electrostatic image on the photosensitive drum 2 so as to develop the latent image into a visible toner image. This developing process is generally referred to as the magnet brush developing process.

A transfer printing station is disposed adjacent the developing station. In this station, the toner image on the surface of the photoconductive strip 1 is transferred to and formed on a copy sheet or a supporting surface by transfer printing. More specifically, the toner image formed on the photoreceptor is transferred to and formed by transfer printing on a copy sheet 16 which may be made of paper or other suitable material. The copy sheet 16 is automatically fed by a pair of copy sheet feed rollers 17*a* and 17*b*. When the copy sheet 16 is brought into contact with the toner image on the photoreceptor on the photosensitive drum 2, the toner image is transferred to and formed on the copy sheet 16 by an electrostatic transfer printing device 18 which is of the same type as the aforementioned charging device 10 and comprises an array of a corona discharge electrode or electrodes 19 and a shield member 20. The device 18 produces a static charge so as to electrostatically attract the toner image on the photoreceptor to the surface of the copy sheet 16.

It is to be understood that the electrostatic transfer printing device 18 may be replaced by a pressure applying transfer printing device comprising a pressure applying roller adapted to apply pressure to the copy sheet in contact with the toner image on the photoreceptor, and that both an electrostatic and a pressure applying transfer printing device may be used in combination.

Disposed adjacent the transfer printing station is a stripping station in which is disposed a stripping device comprising a pick-off claw 21 for stripping the copy sheet 16 off the photoreceptor after the toner image is formed on the copy sheet. After being stripped off the photoreceptor by the stripping device 21, the copy sheet 16 is delivered to an image fixing station (not shown).

The reason why the portion of the photoconductive strip 1 serving as a photoreceptor is not applied to the entire outer periphery of the cylindrical supporter 4 but is applied to only about three quarters of that outer periphery is as follows. In forming an electrostatic image on the portion of the photoconductive strip 1 on the outer periphery of the supporter 4, a slit exposure optical system (not shown) is used. It moves above the photosensitive drum 2 and forms the electrostatic image on the photoreceptor through the optical system 11. While the slit exposure optical system is being returned to its original position, no electrostatic image is formed on the photosensitive drum 2. Thus, the presence of the photoreceptor in a portion of the outer periphery of the cylindrical supporter 4 above which the slit exposure optical system moves in its movement back to the original position is of no avail. On the contrary, the presence of the photoreceptor in this portion, designated $4_o$, which occupies about one-fourth the outer periphery of the cylindrical supporter 4, does more harm than good. That is, toner powder would unnecessarily adhere thereto, to increase the powder consumption and to place a burden on the cleaning device. Thus, a photoreceptor is not provided on this portion $4_o$ of the outer periphery of the cylindrical supporter 4, but is applied only to the portion of the outer periphery of the supporter 4 which is required to have a photoreceptor. An additional advantage is the resulting more economical use of the photoconductive strip 1, which is expensive.

It is for the reasons described above that no photoconductive strip 1 (photoreceptor) is disposed on a minor, e.g., a one quarter portion of the outer periphery of the cylindrical supporter, with the photoconductive strip being disposed only on a major, e.g., a three quarter portion only.

The photosensitive drum 2 having its outer periphery constructed as aforementioned has a seal member provided at one edge of each of slits 4*a* and 4*b* so that the developing agent or toner powder may not find its way into the interior of the cylindrical supporter 4. The seal members 4*c* and 4*d* are made of rubber or other soft material so that the surface of the photoconductive strip 1 would be scratched and damaged by the seals when it is pulled out of or withdrawn into the interior of the supporter 4. the members 4*c* and 4*d* have their bases secured by synthetic resin screws 22 and 23 to the minor diameter portion $4_o$ of the cylindrical supporter 4 on which no photoconductive strip 1 is disposed. The seal members 4*c* and 4*d* are preferably made of rubber having an electric resistance of $10^9$ to $10^{10}\Omega$cm.

The aforementioned magnet brush method has the disadvantage of producing a fog in the background of the developed copy sheet. In order to obviate this, a bias voltage may be impressed on the magnet brush. As shown in FIG. 4, the magnetic brush 15 may be connected to a bias power source E to impress a bias voltage thereon. However, the impression of such bias voltage on the magnetic brush 15 also has a disadvantage; specifically, it results in a bias current flowing through the minor diameter portion $4_o$ of the outer periphery, and tone adheres thereto when the magnetic brush 15 is brought into contact with this portion $4_o$. If toner powder adheres to this minor portion $4_o$ of the cylindrical supporter, (1) toner is wasted, (2) the cleaning brush (fur brush) is soiled, and (3) the charging device 10 and a quenching lamp (not shown) are soiled.

SUMMARY OF THE INVENTION

The present invention has as its object the provision of a photosensitive drum which obviates the aforementioned disadvantages. This is done by electrically insulating, in a specified manner, a portion of the outer periphery of a cylindrical supporter of the photosensitive drum on which no photoconductive strip or no photoreceptor is dispoed.

According to the invention, there is provided a photosensitive drum for electrophotographic copying machines comprising a cylindrical supporter including a supply reel and a take-up reel disposed in the interior of the cylindrical supporter, and a photoconductive strip made of a pliable material and mounted at one end in roll form on the supply reel and at the other end on the take-up reel. The cylindrical supporter has an outer periphery divided into a major peripheral portion and a minor peripheral portion by two axial slits formed in the outer periphery. A portion of the photoconductive strip being paid out of the supply reel is applied to the major peripheral portion to serve as a photoreceptor. The minor peripheral portion of the cylindrical supporter is provided with an electrically insulated layer treated and rendered electrically insulated to have an electric resistance of 1 to $5 \times 10^9 \Omega$cm and defined properties relating to static charging by friction.

DESCRIPTION OF A PREFERRED EMBODIMENT

Figure 1:
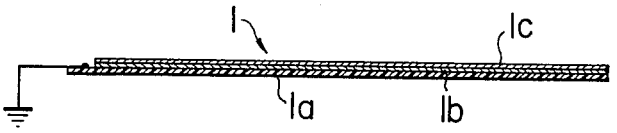
FIG. 1 PRIOR ART
FIG. 1 is a sectional view of a prior art photoconductive strip serving as a photoreceptor.
Figure 2:
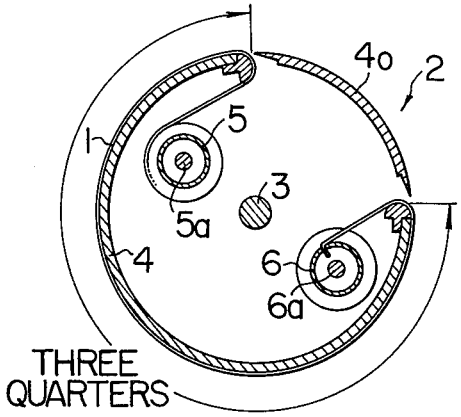
FIG. 2 PRIOR ART
FIG. 2 is a sectional view of a prior art photosensitive drum showing the manner in which the photoconductive strip wound in roll form at one end on a supply reel is wound at the other end on a take-up reel after a portion of the strip is applied to a major portion of the outer periphery of the drum to serve as a photoreceptor.
Figure 3:
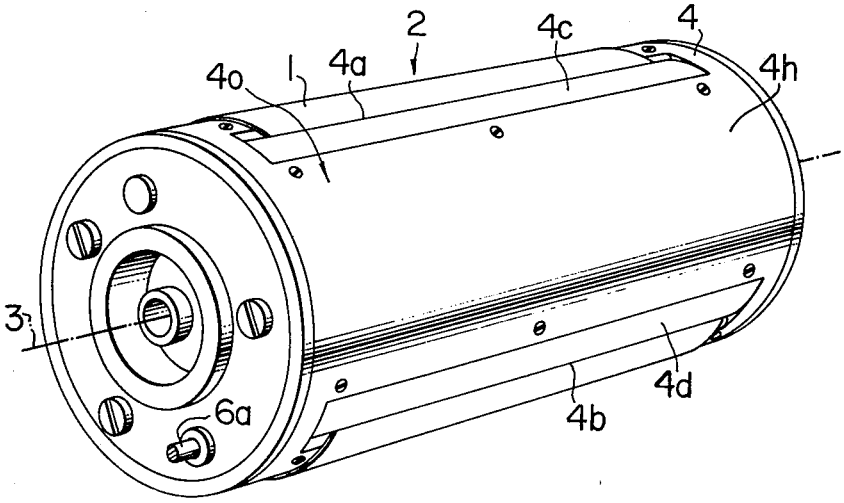
FIG. 3 PRIOR ART
FIG. 3 is a perspective view of the prior art photosensitive drum in which this invention may be incorporated.
Figure 4:
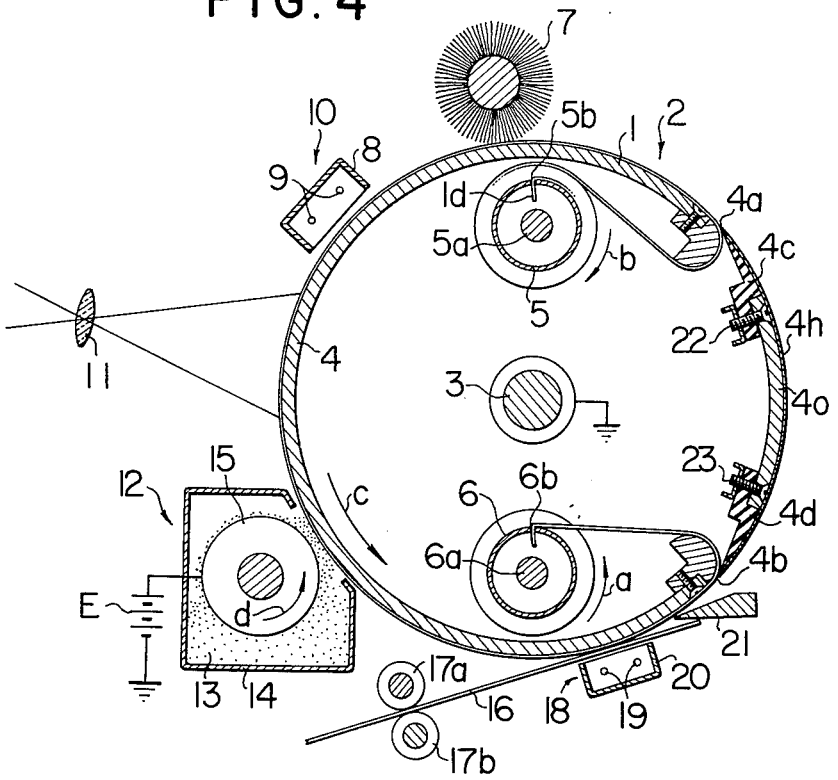
FIG. 4 is a schematic view showing a process of producing duplicates of an original by electrophotographic transfer printing using a photosensitive drum in which the invention is incorporated.
Figure 5:
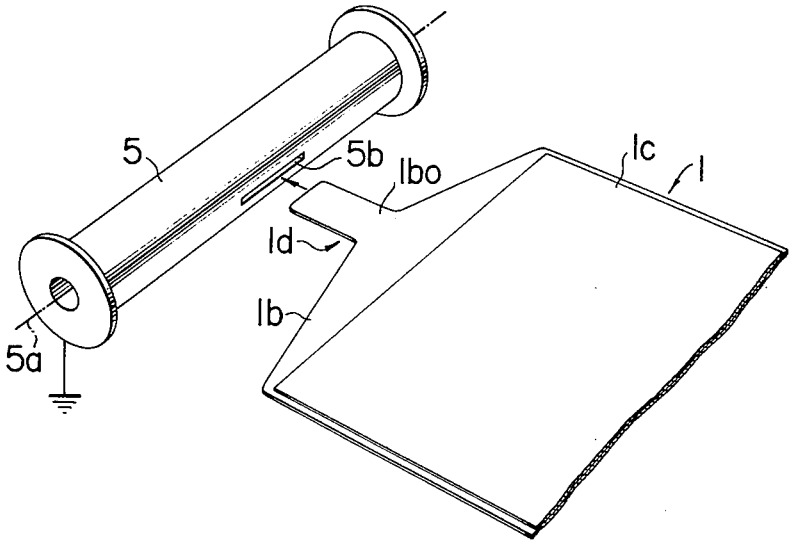
FIG. 5 PRIOR ART
FIG. 5 is a perspective view of the take-up reel for the photoconductive strip.

The disadvantages of the pertinent prior art devices discussed above result from toner adhering to the minor portion $4_o$ of the outer periphery of the photosensitive drum. The subject invention ingeniously obviates these disadvantages by insulating this minor portion in a specified manner.

In accordance with the invention, it has been found that the following parameters are important for obviating the aforementioned disadvantages.

1. The surface of the minor portion $4_o$ of of the outer periphery of the photosensitive drum 2 should preferably have an electric resistivity in the range of from 1 to $5 \times 10^9 \Omega$cm;
2. Any material used for rendering this minor portion electrically insulating should be such that it is not caused to carry a charge when engaged frictionally by the cleaning brush 7. Alternately, the material should be such that the frictional engagement with the brush 7 gives it a charge of the same polarity as that of the toner, to thereby cause it to repel toner.
3. Any material used for rendering the minor portion $4_o$ electrically insulating should be such that it is not electrically charged by frictional contact with the iron powder used to form a magnet brush employed in the magnet brush developing process. Alternately, the material should be such that frictional contact with the iron powder causes it to carry a charge of the same polarity as that of the toner, to thereby cause it to repel toner; and
4. Any material used for rendering this minor portion electrically insulating should have a strength such that the surface of the minor portion is not scratched and damaged by the iron powder in the developing agent when that surface is brought into frictional contact with the iron powder.

By taking these requirements into consideration, the material used on the surface of the minor portion of the outer periphery of the photosensitive drum is selected, in one embodiment of the present invention, from the group consisting of almite, enamel, ebonite, methacrylate resins, acetate resins and nylon which are not negatively charged (when the toner is positively charged).

In a specific embodiment of the invention, the minor portion $4_o$ of the outer periphery of the photosensitive drum 2 which has no photoreceptor applied thereto is coated with hard almite to provide an electrically insulated layer **4*h*** that is $50\mu$ thick. In actual tests, a photosensitive drum made according to this embodiment of the invention proved satisfactory in operation. Specifically, the minor portion $4_o$ of the outer periphery of this drum had an electric resistivity of 1 to $5 \times 10^9 \Omega$cm; the minor portion $4_o$ was not charged when brought into frictional contact with the iron powder of a magnet brush or with a cleaning brush made of Teflon. No leakage occurred through this portion; no destruction was caused by the frictional contact with iron powder; and no toner adhered to the minor portion $4_o$ when developing of an electrostatic latent image was carried out by the magnet brush developing process.

The tests discussed above showed that photosensitive drums incorporating the invention successfully obviate the aforementioned disadvantages of the prior art, and offer the advantages of simplicity and low cost.

We claim:

1. An electrophotographic copying machine having a rotatable drum, with a major portion of the circumference of the drum comprising a photoreceptor and at least a substantial portion of the remaining minor portion of the circumference of the drum comprising an electrically insulating layer, and including a cleaning brush engaging frictionally the circumference of the drum as the drum rotates, wherein said electrically insulating material is made of a substance which is not electrically charged to a polarity opposite a selected polarity by said frictional engagement with the cleaning brush during rotation of the drum.

2. An electrophotographic copying machine having a photosensitive drum comprising a cylindrical supporter including a supply reel and a take-up reel disposed in the interior of the cylindrical supporter, and a photoconductive strip made of a pliable material and mounted at one end in roll form on said supply reel and at the other end on said take-up reel, said cylindrical supporter having an outer periphery divided into a major peripheral portion and a minor peripheral portion by two axial slits formed in the outer periphery, a portion of said photoconductive strip being paid out of said supply reel and applied to the major peripheral portion of the cylindrical supporter to serve as a photoreceptor, wherein the improvement comprises an electrically insulating layer provided on said minor peripheral portion of the cylindrical supporter, said electrically insulating layer having an electric resistivity of 1 to $5 \times 10^9 \Omega$cm, and wherein said electrically insulating layer is made of a material selected from the group consisting of almite, enamel, ebonite, methacrylate resins, acetate resins and nylon.

3. An electrophotographic copying machine having a photosensitve drum comprising a cylindrical supporter including a supply reel and a take-up reel disposed in the interior of the cylindrical supporter, and a photoconductive strip made of a pliable material and mounted at one end in roll form on said supply reel and at the other end on said take-up reel, said cylindrical suporter having an outer periphery divided into a major peripheral portion and a minor peripheral portion by two axial slits formed in the outer periphery, a portion of said photoconductive strip being paid out of said supply reel and applied to the major peripheral portion of the cylindrical supporter to serve as a photoreceptor, and including a magnet brush developing device with toner charged at a selected polarity, said developing device engaging frictionally said minor peripheral portion of the cylindrical supporter when the photosensitive drum is rotating, wherein the improvement comprises an electrically insulating layer provided on said minor peripheral portion of the cylindrical supporter, to be engaged frictionally by said magnet brush developing device when the drum is rotating, said electrically insulating layer having an electric resistivity of 1 to $5 \times 10^9 \Omega$cm, and wherein said electrically insulating layer is made of a material that is not statically charged to a polarity opposite that of the toner by said frictional engagement with the magnet brush developing device.

4. An electrophotographic copying machine as in claim 3 including a cleaning brush engaging frictionally the electrically insulating layer when the photosensitive drum is rotating, wherein the electrically insulating layer is made of a material which is not statically charged to said polarity different from that of the toner by said frictional engagement with the cleaning brush.

5. An electrophotographic copying machine having a rotatable drum, with a major portion of the circumference of the drum comprising a photoreceptor and at least a substantial portion of the remaining minor portion of the circumference of the drum comprising an electrically insulating material, and including a magnet brush developing device in frictional engagement with the circumference of the drum, said developing device including toner electrically charged to a selected polarity, wherein the electrically insulating material is made of a substance which is not statically charged to a polarity opposite that of the toner by said frictional engagement with the developing device during rotation of the drum.

6. An electrophotographic copying machine as in claim 5 including a cleaning brush frictionally engaging in the circumference of the drum as the drum rotates, said insulating material being made of a substance which is not statically charged to said polarity opposite that of the toner by said frictional engagement with the cleaning brush during rotation of the drum.

7. An electrophotographic copying maching having a rotatable drum, with a major portion of the circumference of the drum comprising a photoreceptor and at least a substantial portion of the remaining minor portion of the circumference of the drum comprising an electrically insulating material, and including a magnet brush developing device having toner charged to a selected polarity, said developing device being in frictional engagement with the circumference of the drum to develop latent images thereon as the drum rotates, wherein said electrically insulating material is made of a substance which is not electrically charged to a polarity opposite that of the toner by frictional engagement with the developing device during rotation of the drum.

* * * * *